United States Patent [19]

Arnone

[11] Patent Number: 4,949,472

[45] Date of Patent: Aug. 21, 1990

[54] DRYER FOR LACQUER COATED PHOTOGRAPHS

[76] Inventor: Joseph A. Arnone, 258 Briggs St., Syracuse, N.Y. 13208

[21] Appl. No.: 371,606

[22] Filed: Jun. 26, 1989

[51] Int. Cl.[5] ..... F26B 19/00

[52] U.S. Cl. ..... 34/48; 34/151; 34/205; 34/236; 354/319

[58] Field of Search ..... 34/39, 205, 236, 86, 34/48, 151; 354/319

[56] References Cited

U.S. PATENT DOCUMENTS 4,189,631 2/1980 Baker et al. .
4,275,959 6/1981 Jones .
4,411,075 10/1983 Blaudszun .
4,486,172 12/1984 Dunning .
4,501,072 2/1985 Jacolsi, Jr. et al. ..... 34/1
4,733,054 3/1988 Paul .

*Primary Examiner*—Henry A. Bennet
*Assistant Examiner*—John Sollecito
*Attorney, Agent, or Firm*—Wall and Roehrig

[57] ABSTRACT

A dryer for photographs sprayed with lacquer has an endless conveyor belt for transporting the photograph under infra red heaters enclosed in an exhaust hood. A second conveyor under the first receives the photo via an air transfer and returns it to the operator. Controls for preventing scorching of the photograph and for operating the device are provided.

11 Claims, 4 Drawing Sheets

DRYER FOR LACQUER COATED PHOTOGRAPHS

BACKGROUND OF THE INVENTION

This invention relates to a dryer for drying photographs that have been sprayed with a protective lacquer coating and a method of drying which includes capturing and removal of the solvent elements from the lacquer as it is drying in order to meet environmental and safety standards for equipment of this type.

For many years it has been common practice in preserving photographs to spray them with a clear lacquer material that when dry, provides a hard protective coating that retains the original developed photographic emulsions in a safe and attractive condition. As the concerns over the effects of the solvents released in lacquer coating operations have increased, it has become necessary to make sure that the amount of solvents in the air surrounding the drying machines is kept to a bare minimum so as not to jeopardize the health or safety of the operators of the machine or others in the immediate area around the coating operations.

OBJECTS AND SUMMARY OF THE INVENTION

It has become desirable to capture the volatile components of the lacquer coating as they are given off in the drying process and to exhaust them to suitable facilities for meeting environmental discharge standards. In the past, photographs have been sprayed with a lacquer coating and merely laid out on racks or shelves in a room to dry. This has created an atmosphere that potentially could be harmful to persons breathing it, and also the flammable nature of some of the solvents could pose an explosion or fire hazard.

Accordingly, it is an object of the present invention to provide a drying machine and method for drying a lacquer coating on photographs that will capture the volatile components of the lacquer given off during the drying operation and safely remove them from the environment surrounding the drying photographs.

It is another object of the present invention to provide a drying machine for drying lacquer coating on photographs that improves the drying process, speeds up the time required for the drying process, and at the same time protects the photographs from damage due to excessive temperatures created in the drying operation.

It is another object of the present invention to provide a drying apparatus for use with lacquer spraying apparatus of manual or automatic types that will receive a wet photograph and dry it while removing the volatile components of the lacquer coating in a safe and environmentally acceptable manner.

It is another object of the present invention to provide a photograph drying apparatus for drying lacquer coatings on photographs that will automatically dry the wet photographs, without the necessity of operator attention, while at the same time removing the volatile components of the lacquer coating in an environmentally acceptable and safe fashion.

It is a still further object of the present invention to provide a photograph drying machine for drying a lacquer coating that controls the time and temperature of the drying operation so as to prevent damage to the photograph being processed.

It is a still further object of the present invention to provide an automatic photograph drying machine for curing a wet lacquer coating by removing the volatile components in a safe and efficient manner and returning the dried photograph to the operator at the place of beginning of the drying operation so that the machine may be operated automatically in conjunction with other processing equipment by a single operator.

BRIEF DESCRIPTION OF THE DRAWING

Further objects of the invention, together with additional features and advantages accruing therefrom, will be apparent from the following description of a preferred embodiment which is shown in the accompanying drawing, wherein.

DETAILED DESCRIPTION OF A PREFERRED EMBODIMENT

Figure 1:
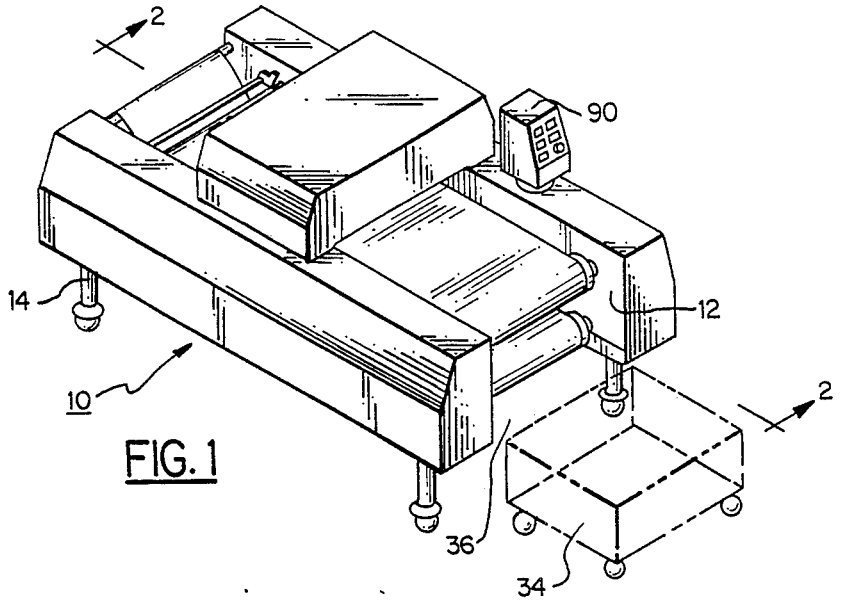
FIG. 1 is a perspective view of the machine of the present invention.

Referring now to FIG. 1 there is shown a dryer 10 according to the present invention which has a frame portion 12 mounted on legs 14. Mounted within the framework of the machine are a pair of endless conveyor belts 16 and 18 with the lower belt 16 extending beyond the upper belt 18 as shown on the left in FIG. 2. The upper belt 18 has an input area 20 at the right end of FIGS. 1 and 2 which is adapted to receive thereon the photographs to be dried. The photograph from the spraying operation can be manually laid onto the conveyor belt, or it can be conveyed from an automatic spraying machine directly onto the input portion 20 of belt 18.

Disposed along the upper surface of belt 18 is a dryer section 22 which consists of four infrared heater elements 24 (FIG. 3) mounted across the belt so as to provide drying heat throughout the entire cross-sectional area of the conveyor belt 18. These infrared heater elements 24 are mounted in a frame work that also supports at least two pipes 26 that have a series of holes 28 in the upper surface thereof and which are connected to an exhaust blower 30, as will be described herein to remove the vapors driven off from the lacquer coating of the photograph as it passes beneath the heaters.

Positioned adjacent the end of the upper belt 18 as it exits the drying section is an air assist transport means 32 for lowering the dried, but still warm and sticky photograph from the upper belt to a lower belt to return it to the point of beginning. The lower conveyor belt 16 will transport the photographs dropped on to its left end back to the right in FIG. 2 where they are dropped into a basket 34 which can be of a wire mesh or plastic configuration to easily and simply receive the dried photographs as they come off the conveyor belt 16 for transfer to the final processing steps of the photographic finishing operation. The basket 34 can be mounted on wheels or skids as desired for appropriate interaction with the dryer itself. A suitable chute 36 may be provided to assist in the transfer of the finished print from the conveyor belt 16 to the basket 34.

Figure 3:
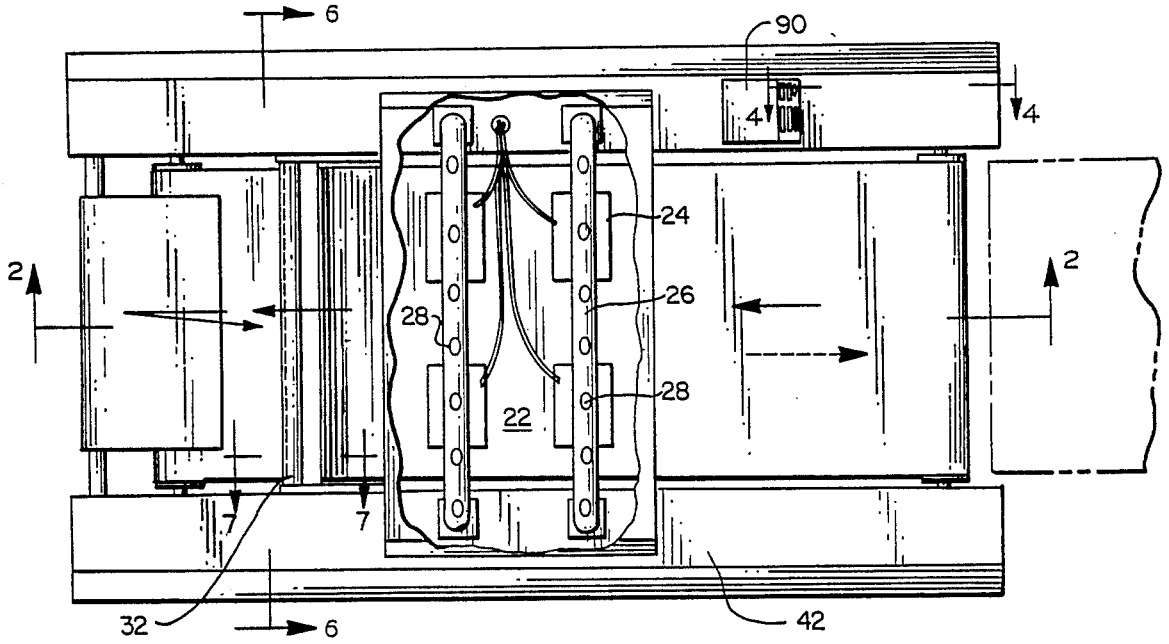
FIG. 3 is a top plan view with the heater cover broken away.
Figure 5:
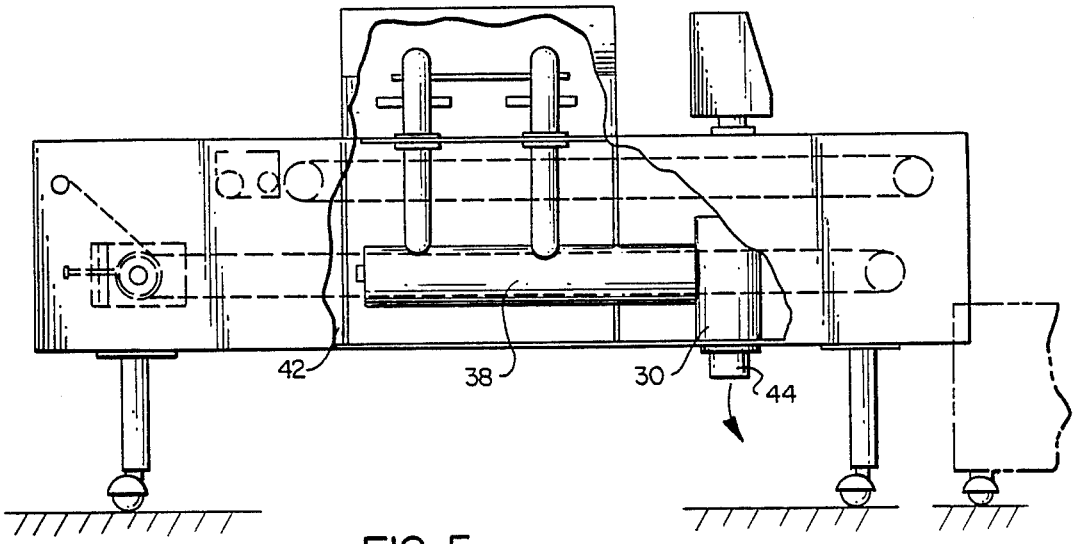
FIG. 5 is a side elevation partially broken away, showing the exhaust manifold and exhaust blower assembly.

Referring now to FIG. 3, the heater section 22 includes not only the infrared heaters 24, but the air ducts or pipes 26 which have large openings 28 on the top thereof to withdraw the heated volatile lacquer vapors being given off by the drying photographs. These pipes 26 are connected to a manifold 38 (FIG. 5) which is connected to the exhaust blower 30 and function when blower 30 is actuated, to draw air into the drying chamber 22 from either side of the cover 40, along the conveyor belt 18 and into pipes 26 as shown by the arrows in FIG. 2. Thus, as the photographs pass through the machine, the volatile components of the lacquer coating are removed along with the excess air sucked in through the side openings of cover. This air is warmed by the heaters 24 as well as dried and it picks up the volatile components of the lacquer coating and feeds them through the exhaust blower. This exhaust can then be discharged to a suitable exhaust cleaning system or as suggested in our copending application filed concurrently herewith, the exhaust can be fed to the paint spraying operation where it is used to assist in the proper conditioning of the photograph for the spraying of the lacquer coating. This air has generally less than fifty percent humidity and is in the temperature range of 180° to 200° F. degrees, which is well suited to preconditioning a photograph for lacquer coating. If not used in this fashion, this exhaust air will be discharged to a suitable processing operation to meet the required environmental discharge regulations for the facility. This manifold and collection system is mounted within the side compartment 42 shown in FIGS. 3 and 5 and exhausts through the exhaust pipe 44 where it may be conveyed by a hose, now shown, to either the spray booth operation or to the facility exhaust treatment system.

Figure 4:
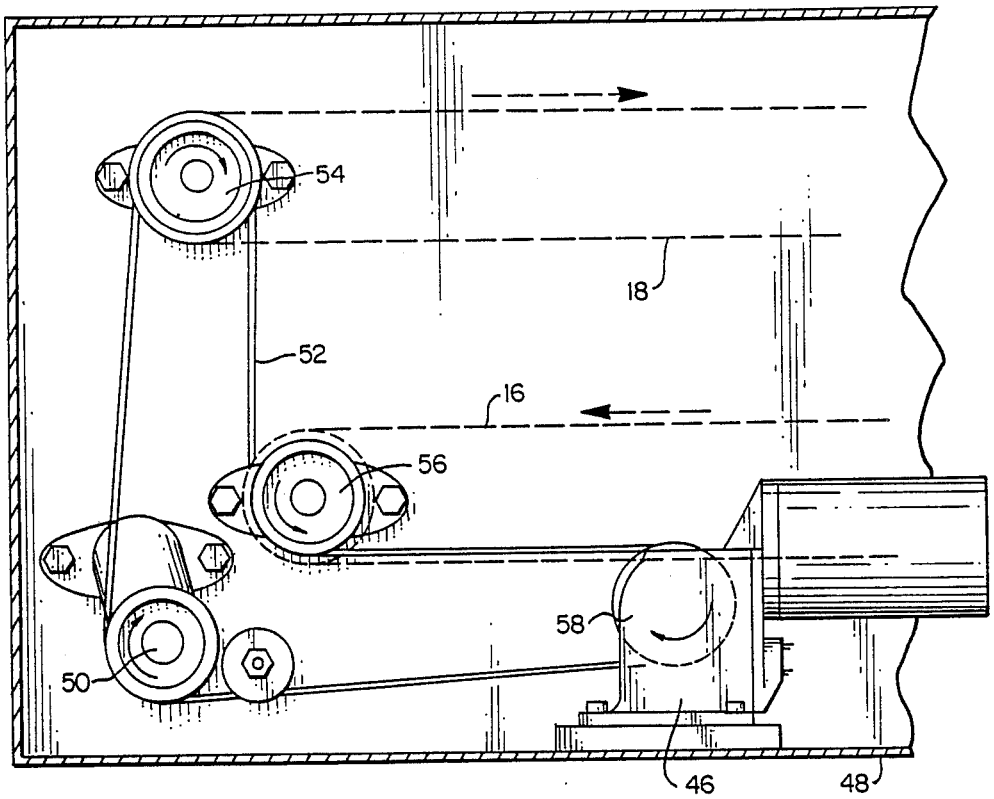
FIG. 4 is an enlarged partial side elevation taken from the opposite side of the machine from FIG. 1.

Referring now to FIG. 4, there is shown the drive system for the conveyor belts. Motor 46 is mounted on the frame 48 and has a pulley 58 which drives belt 52 which engages the pulleys on the endless conveyor belts. Belt 52 is fed around an idler tension pulley 50, pulley 54 on the upper conveyor at the front end of conveyor belt 18, and then down and around pulley 56 on the drive roller for the lower belt 16, and back to the motor pulley 58, which is driven by a gear motor such as a Dayton 4Z726 90 volt DC 70:1 reduction motor. This allows the conveyor belts 16 and 18 to be rotated at a proper speed for drying of the photographs as they pass under the infrared dryers 24. The speed of travel of the belts is regulated by controlling the speed of the drive motor 46. In some situations it may be desirable to speed up or slow down the transit time, depending upon the particular emulsions or the type of print paper and so forth in the photographs being processed.

Figure 8:
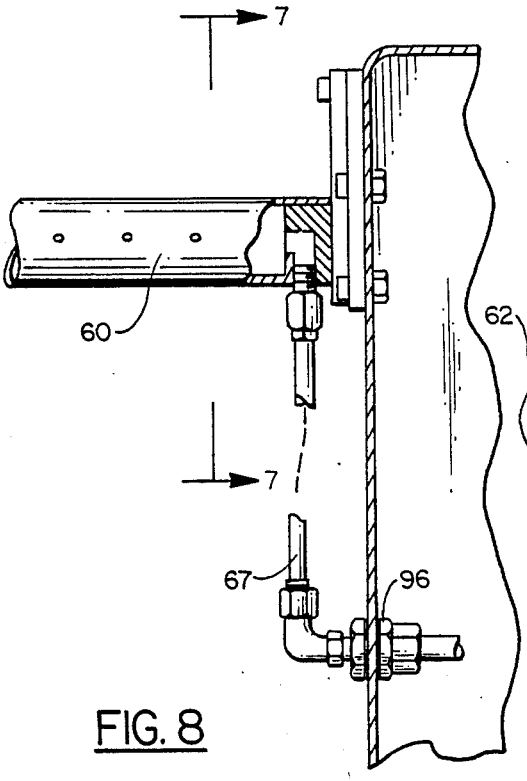
FIG. 8 is a sectional view of the air supply for the air assist assembly.
Figure 7:
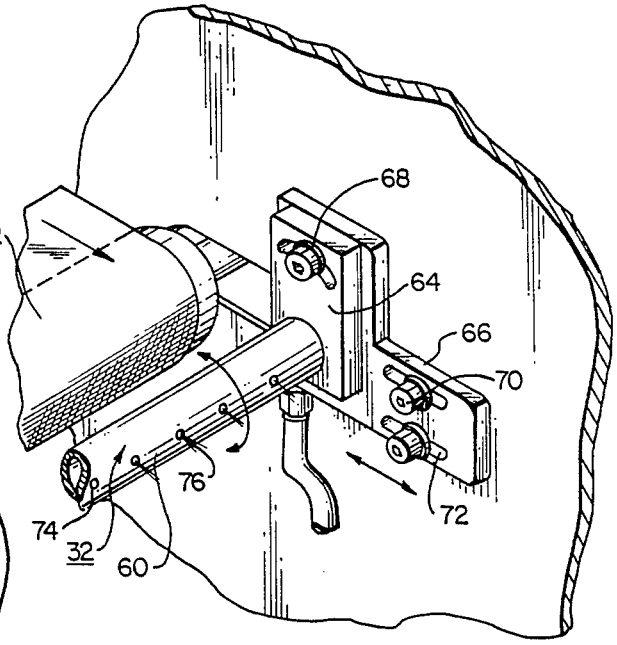
FIG. 7 is an enlarged partial perspective view of the air assist assembly.
Figure 6:
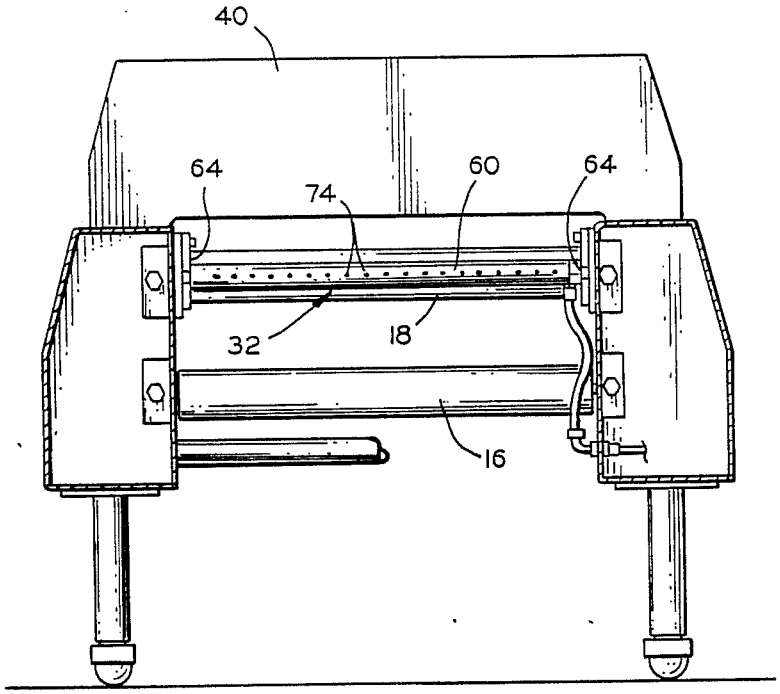
FIG. 6 is an end view taken from the left end of FIG. 5.

Referring now to FIGS. 6–8 there is shown the special air assist transport mechanism 32 for taking the dried, but still warm and soft photograph from the upper conveyor belt and lowering it to the lower conveyor belt for transport back to the operating position of the dryer machine.

As may be seen, the air transport mechanism consists of a cylinder 60 extending across the machine just after the end of the upper conveyor belt and closely adjacent to the conveyor belt drive roller 62 for belt 18. Cylinder 60 is hollow and has a row of small holes 74 drilled along its length. This cylinder 60 is mounted on a pair of brackets 64 at each end thereof, which brackets are pivotally mounted on plates 66 by bolts 68. Plates 66 are secured to the frame by bolts 70 in slots 72.

Figure 2:
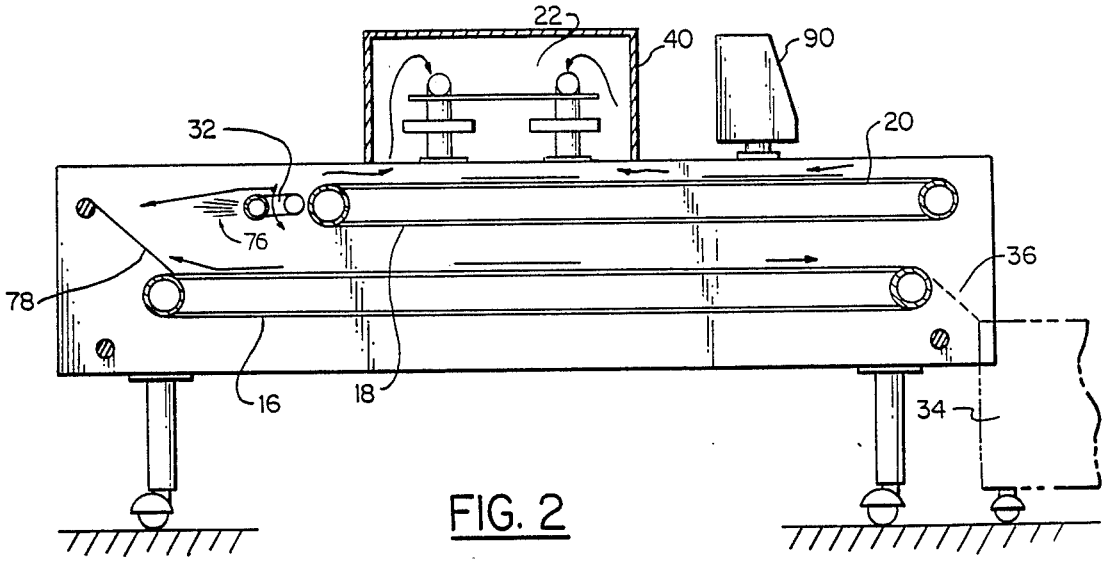
FIG. 2 is a sectional view taken on line 2—2 of FIG. 1.

Connected to the cylinder 60 is a hose 67 which is connected to a low pressure air supply. The air supplied to the cylinder 60 is generally of a pressure of five to ten PSI. The holes 74 drilled along one diameter of cylinder 60 across its length are spaced apart approximately one inch. Air supplied to the cylinder then is expelled through these holes forming small jets 76 of low pressure air extending outwardly like fingers which function to slowly lower the photograph coming off the upper belt while keeping it in an upright position as it falls under the effect of gravity down to the lower conveyor belt. The precise position and direction of the air assist can be adjusted for different size and weight photographs being processed. To make sure that the photograph does not fly off the end of the lower belt, the baffle 78 is provided as shown in FIG. 2 to direct the photographs back onto the lower belt 16. In the air supply system for cylinder 60, there is provided a regulator and gage for controlling the air pressure to the cylinders so that the air fingers 76 extending outwardly from the holes 74 can be adjusted to properly handle the particular size photograph being processed. Obviously, larger heavier photographs will need a greater amount of air, while smaller lighter photographs will need less. The air pressure along with the position of the cylinder 60 is adjusted to suit each individual type of photograph being processed to insure that the photograph settles down with the uncoated side resting on the lower conveyor belt for transporting of the picture back to the operating station of the dryer mechanism.

Figure 9:
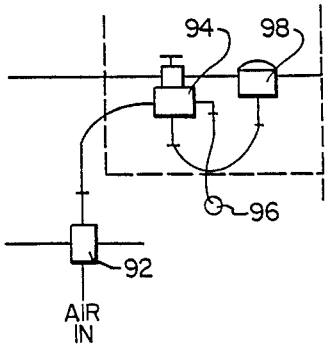
FIG. 9 is a schematic of the control system for the air supply.

Referring now to FIG. 9 there is shown a schematic diagram of a control system for the air assist system. Air from a compressor (not shown) is fed through a solenoid controlled on-off valve 92 to a pressure regulator 94 and then to the bulkhead connection 96 shown in FIG. 7. For convenience of the operator, an air pressure gauge 98 is provided adjacent the regulator.

As the pictures return on the lower conveyor belt to the operating station of the dryer, they cool off and harden enough so that they can be dropped into a print basket 34 without any damage thereto.

Figure 10:
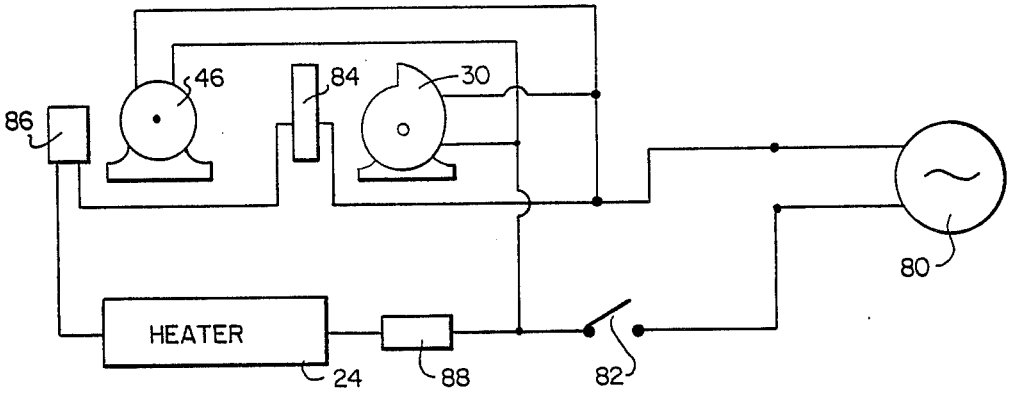
FIG. 10 is a block diagram of a control system for controlling the dryer of the present invention.

Referring now to FIG. 10 there is shown in block diagram form a control system for the dryer including a circuit to insure that the heaters are not turned on unless the rest of the dryer device is operating properly. As shown, there is a source of power 80 which is connected through the usual on/off switch 82 to the heaters 24 and to the exhaust air blower 30 and the conveyor drive motor 46 on one side of the circuit. The other side of the circuit is connected to the blower motor 30, an air sensor 84, the conveyor drive motor 46, a belt movement and speed sensor 86, and then to the heater 24. In addition there is provided a heat sensor 88 which is in a normally closed position, but which will open when the heat exceeds a predetermined set point to prevent burning of the photograph finish. Heat is applied to the heater through this circuitry and it is apparent that in operation, unless the exhaust blower motor is operating and air is being drawn through the exhaust system, and unless the conveyor drive motor is running and the belt is running at the desired speed, power cannot be applied to the heater. The controls and circuitry for monitoring the operation of the dryer are contained within the control module 90 mounted on the right hand side of the frame of the dryer as shown in FIGS. 1–3. This presents the controls and the sensor information in a convenient location for the operator to turn the machine on and off and to regulate or control its operation.

In operation, a wet photograph to be dried is placed on the input portion 20 of the upper conveyor belt 18 and assuming that proper air and belt movement have been sensed and excessive heat is not present, the conveyor belt will carry the photograph to the left in FIGS. 1 and 2 and underneath the infrared heaters 24 within the heater compartment 22. The speed of the belt 18 is controlled in conjunction with the temperature of the heaters 24 to insure thorough drying without burning of the emulsion on the photograph which obviously, would destroy the quality of the photograph. As the belt 18 continues to move past the infrared heaters 24, the volatile components of the lacquer are driven off and captured by the air flowing in under the edges of the cover 40 and up to the pipes 26 and into the holes 28 from where the air containing the volatile components of the lacquer is drawn to the exhaust blower 30 and sent to the exhaust processing or paint spraying operation as desired. The photograph then passes on to the end of conveyor belt 18, and as it starts to fall off the end, it is picked up by the air transport system 32 and lowered down to the lower conveyor belt under the effects of gravity, without being turned over, so that it falls onto the lower conveyor belt with its unlacquered side in contact with the belt. As the print travels back on belt 16 toward the point of origin of the machine to the operator, it is cooled and hardened so that when it gets to the right hand end of FIGS. 1 and 2, it can be discharged into the print basket 34 without any damage to the emulsion on the print.

While the invention has been described in the specification and illustrated in the drawings with reference to the preferred embodiment, it will be understood by those skilled in the art that various changes may be made without departing from the scope of the claims.

What is claimed is:

1. An environmentally acceptable apparatus for drying photographic materials comprising:

a frame member;

first conveyor means mounted in said frame member;

second conveyor means mounted in said frame member adjacent said first conveyor means;

heater means mounted adjacent but spaced from said first conveyor means;

air exhaust means disposed about said heater means for removing heated air, solvents and the like emitted from the material being dried;

transfer means for transferring the photographic material from said first conveyor means to said second conveyor means without turning said material over; and control means operatively connected to said heater means for limiting the heat applied so as to prevent scorching of the photographic material.

2. An apparatus as described in claim 1 wherein said first and second conveyor means comprise a first endless conveyor belt travelling in one direction and the said second conveyor means comprises a second endless conveyor belt travelling in the reverse direction and positioned below said first conveyor means.

3. The apparatus of claim 2 further defined by said second conveyor belt having a length greater than said first.

4. An apparatus as described in claim 2 wherein said transfer means comprises a hollow cylinder mounted closely adjacent the output end of said first conveyor means;

a plurality of small holes drilled along a diameter of said hollow cylinder;

low pressure air supply means for providing air to said cylinder;

a plurality of air streams exiting said holes formed by said air supply means; and adjustable mounting means for said cylinder so that said air streams may be directed against the underside of photographic materials exiting said first conveyor means to insure that they fall down onto the lower second conveyor means without turning over.

5. An apparatus as defined in claim 4 further defined by control means for said air supply comprising a pressure regulator disposed to control the air supplied to said cylinder to vary the effective length of the air streams extending from the small holes in said cylinder.

6. An apparatus as defined in claim 5 wherein said adjustable mounting means comprises a pair of slotted mounting plates at each end of said cylinder, a pair of bolts disposed in said slots securing said plates to the machine frame and a pair of brackets pivotally mounted on said plates at one end and secured to said cylinder at the other end.

7. An apparatus as described in claim 1 further defined by said exhaust means comprising a plurality of pipes disposed over the top surface of said first conveyor means; and said heater means comprises a plurality of infrared heater elements mounted underneath said exhaust pipes so that volatile components released from the lacquer coating on the photographic material passing thereunder will be exhausted through said exhaust pipes to a master exhaust processing system.

8. An apparatus as defined in claim 7 further defined by said plurality of pipes being connected to a manifold member and an exhaust fan operatively connected to said manifold.

9. An apparatus as described in claim 7 wherein said plurality of pipes comprise cylindrical tubes disposed horizontally above and transversely to said first conveyor means each having a plurality of openings in the upper surface thereof to draw the volatile components released from the photographic material therethrough into the exhaust system.

10. An apparatus as described in claim 1 wherein said air exhaust means includes an enclosure surrounding said heater and positioned closely adjacent the first conveyor means; at least one exhaust pipe disposed above said heater means within said enclosure; a plurality of holes formed in said exhaust pipe; said exhaust pipe being connected to said exhaust means so that the solvents driven off from the photographic material by the heater means will be captured within said enclosure and exhausted through said exhaust means.

11. An apparatus as described in claim 1 further defined by said control means comprising first sensor means for determining the speed of movement of the first conveyor means, second sensor means for sensing the movement of air through said exhaust means, third sensor means for determining the temperature of the heated drying compartment, and circuit means connecting said sensor means to said heater so that the heater cannot energize unless all sensors indicate proper operating conditions.

* * * * *